United States Patent [19]

Paietta

[11] 4,346,856

[45] Aug. 31, 1982

[54] DEVICE FOR AUTOMATIC REWINDING OF MATERIAL DELIVERED IN SHEETS IN HELIOGRAPHIC AND SIMILAR MACHINES

[75] Inventor: Fausto Paietta, Bareggiò, Italy

[73] Assignee: C.M.E. F. Lli Paietta, Bareggio, Italy

[21] Appl. No.: 201,612

[22] Filed: Oct. 28, 1980

[30] Foreign Application Priority Data

Oct. 30, 1979 [IT] Italy ..... 26919 A/79

[51] Int. Cl.[3] ..... B65H 75/28

[52] U.S. Cl. ..... 242/74; 242/74.1

[58] Field of Search ..... 242/59, 74, 74.1, 74.2, 242/67.1 R

[56] References Cited

U.S. PATENT DOCUMENTS

| | | | |
|---|---|---|---|
| 1,902,826 | 3/1933 | Bobo | 242/74 X |
| 2,911,163 | 11/1959 | Warrick | 242/74 |
| 3,347,486 | 10/1967 | Martin | 242/74.2 |
| 3,348,784 | 10/1967 | Gardiner | 242/74.2 X |

OTHER PUBLICATIONS

IBM Technical Disclosure Bulletin, vol. 16, No. 2, (Jul. 1973)–R. H. Harrington and G. S. Kotrch.

*Primary Examiner*—Edward J. McCarthy
*Attorney, Agent, or Firm*—Fleit & Jacobson

[57] ABSTRACT

Device for the automatic rewinding of material delivered in sheets in heliographic and similar machines, particularly for heliographic machines for textile industries, comprising a winding member consisting of a hollow cylindrical casing with a C-shaped cross section, within which is rotatably mounted a shaft equipped with a plurality of radial tabs arranged at regular intervals along its entire length.

The outer edge of the hollow casing and the tabs define a slot into which the leading edge of the sheet to be rewound around the hollow casing is initially inserted. The rotation of the shaft first causes the leading edge of the sheet to remain firmly gripped between the tabs and the edge of the hollow casing, and then pulls the hollow casing round, thus making the sheet of material wind around the latter.

11 Claims, 6 Drawing Figures

DEVICE FOR AUTOMATIC REWINDING OF MATERIAL DELIVERED IN SHEETS IN HELIOGRAPHIC AND SIMILAR MACHINES

BACKGROUND OF THE INVENTION

This invention concerns a device for automatic rewinding of material delivered in sheets in heliographic and similar machines, particularly for heliographic machines for textile industries.

It is well-known that in the field of textile industries, it is necessary to reproduce patterns of considerable length (as long as 10 meters and more) and then to utilize the copies of the patterns themselves for cutting the fabric to be made into clothing.

Therefore, it is necessary, in the heliographic machines employed in this sector, to achieve the rewinding of very long sheets of originals and the copies obtained from them, upon delivery, into rolls which are then unloaded from the machines themselves.

There are heliographic machines currently in use which are equipped with two horizontal rollers for rewinding the two delivered sheets (original and copy), such rollers being connected to a suitable means of power in order to keep them rotating continuously.

The rewinding of the delivered sheets, however, does not take place automatically, insofar as it is necessary to wind the ends of said sheets, as they are delivered from the machine, by hand around the aforementioned rollers for a short while until they are able to grip the latter which, only from this moment on are able to continue the winding without the need for manual operations. Upon completion of the reproduction operation, two rolls will have formed upon the aforementioned rollers and will then be unloaded by temporarily removing the rollers themselves from the heliographic machine.

With this known method however, apart from the inconvenience of manual intervention, another very big problem is encountered and consists of the fact that the operator must very rapidly start winding the two separate sheets, as they are delivered simultaneously from the machine; a fact which calls for special skill and which sometimes causes damage to the sheets to be wound.

Attempts have been made to eliminate this manual intervention by means of automatic winding devices consisting of flexible arched elements fitted in correspondence with the delivery area of the sheets to be rewound.

These arched elements have the task of gradually rolling the sheets as they are delivered from the heliographic machines, however the results achieved have been rather poor due to the fact that the sheets are inclined to crawl (espcially when they present a certain thickness) or do not slide as they form the coils, consequently, they either roll up incorrectly or do not roll up at all.

Moreover, in order to unload the rolls, it is necessary to hold the aforementioned flexible arched elements wide apart, deforming them considerably and resulting in frequency damage to the said elements and in undesirable crushing of the rolled sheets.

SUMMARY OF THE INVENTION

The main aim of this invention is to overcome the aforementioned problems encountered in the known devices, by providing a device for rewinding material delivered in sheets in heliographic machines which requires no initial manual intervention whatsoever and which operates perfectly and with the utmost precision thus guaranteeing that the delivered sheets are rolled precisely and do not suffer any damage whatsoever.

A further important aim of the invention is that of providing a device of the type specified, which ensures the completely automatic rewinding of the delivered sheets, even when the operation is carried out at maximum speed, in order to produce high outputs.

These and still further aims, which will ensue from the following description, are achieved by the device of this invention for the automatic rewinding of material delivered in sheets in heliographic and similar machines, comprising at least one winding member rotating upon its axis, such device being characterized by the fact that said winding member comprises a substantially cylindrical hollow casing rotating idle upon its axis and presenting a substantially C-shaped cross section, determining a lengthwise slot extending along the entire length of said hollow casing, and by a motor-driven shaft rotatably mounted coaxially within said hollow casing and provided with suitable means for securing the leading edge of the sheet of material to be rewound around said hollow casing, after insertion into said slot and for pulling round said hollow casing in order to wind the sheet of material around the latter. In this way, said hollow casing remains stationary until the leading edge of the sheet of material to be rewound is inserted therein, through the aforementioned slot; as soon as this insertion takes place, the abovementioned tabs provided on the motor-driven shaft hold the leading edge of the sheet of material securely against the hollow casing and at the same time pull round the hollow casing so that the sheet of material starts to wind around the latter. The rewinding, therefore, takes place completely automatically.

Further features and advantages offered by this invention will ensue from the detailed description of a preferred but not exclusive embodiment of a device for the automatic rewinding of sheets delivered from a heliographic machine, which is given merely by way of example and is in no way restrictive with reference to the annexed drawings, in which:

DESCRIPTION OF THE PREFERRED EMBODIMENT

With reference to these figures, the device of this invention envisages two winding members 1, extending horizontally, mounted parallely to each other upon a heliographic machine 2, in correspondence with the delivery area of the sheets to be rewound, after they have passed through the heliographic machine 2 itself, the latter being in itself known, especially the type used in textile industries where reproductions of patterns of a considerable length are required.

Each of the aforementioned winding members 1 comprises a substantially cylindrical hollow casing 3, having a C-shaped or any other open shaped cross section, so as to form a lengthwise slot 4 extending along the entire length of the hollow casing itself.

Figure 1:
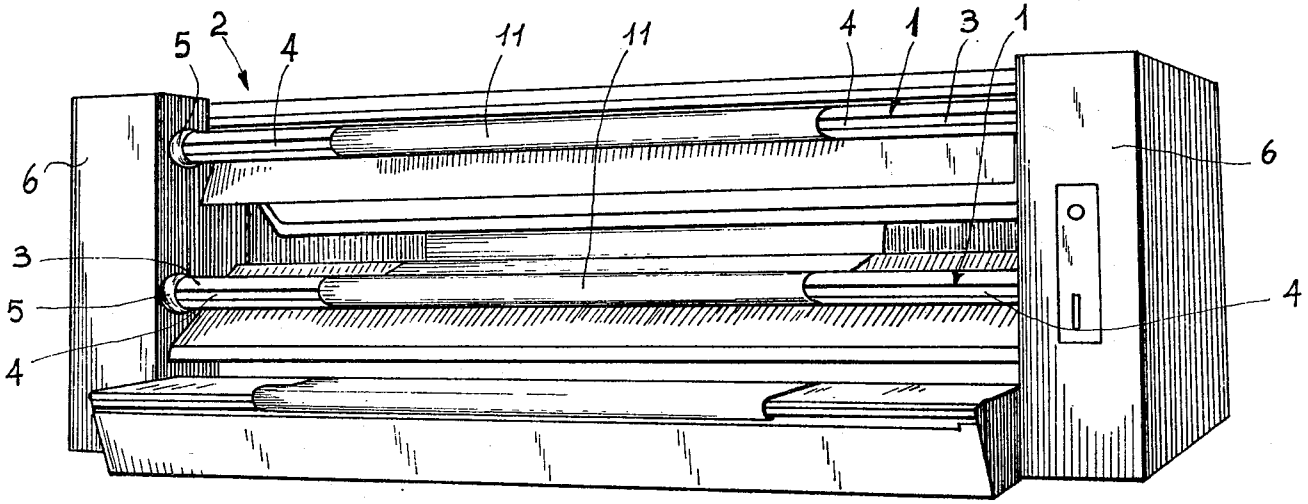
FIG. 1 shows a perspective view of a heliographic machine equipped with the device of this invention.

This hollow casing is envisaged as rigid and rotating idle upon its axis and provided, in correspondence with its ends, with supporting sleeves 5 (FIG. 1) fitted on the headpieces 6 of the heliographic machine 2.

A shaft 7 is mounted coaxially within the hollow casing 3, which extends substantially along the entire length of the casing 3 and is kinematically connected to the means of power of the heliographic machine 2, so as to rotate continuously whenever the machine itself is in operation.

It is foreseen that the aforesaid shaft 7 is made to rotate by means of a clutch (not shown) so as to allow a certain amount of slippage during the rewinding in order to avoid excessive strain upon the sheets as they are rolled up in the way which will be hereinafter described.

Moreover, both the shaft 7 and the hollow casing 3 are detachably mounted, in order to permit the unloading of the completed rolls at the end of each operating cycle, by providing spring joints which are not shown in the figures insofar as they are easily conceivable by experts in the field.

The shaft 7 passes rotatingly through a plurality of supporting sleeves 8 (FIG. 2) which are integral with a strip-shaped plate, such plate being in turn integral with the hollow casing 3 and extending along the entire length of the latter. More precisely, the plate 9 is situated inside the hollow casing 3, in such a way that its edge coincides with one edge of the lengthwise slot 4. The opposite edge of the plate 9 is made to adhere to the inner surface of the hollow casing 3 so that a crosswise inner surface is formed parallel to the shaft 7.

Fitted upon the latter is a plurality of radial tabs 10, all pointing in the same direction, in line with each other and placed along the entire length of the shaft 7. These tabs 10 are shorter in length than the radius of the hollow casing 3 and can therefore rotate within the latter.

Figure 2:
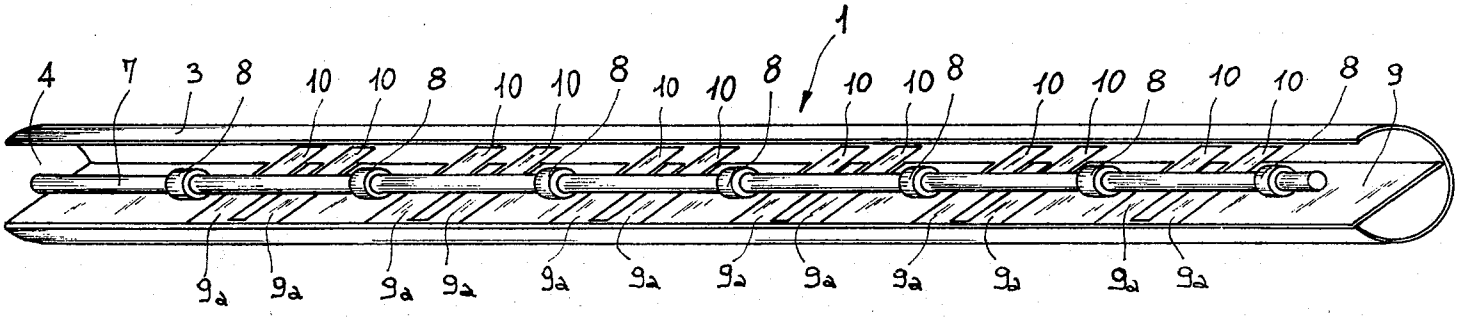
FIG. 2 shows an axonometric view of a winding member of this invention.

In order that the tabs 10 may rotate completely and continuously within the hollow casing 3, a corresponding number of apertures **9*a* are provided in the plate 9, extending crosswise over the entire width of the plate itself (FIG. 2**).

As it will be more clearly seen further on, the aforementioned tabs 10 are designed to grip the leading edge of the sheets 11 to be wound around the hollow casing 3 and then to pull round the latter thereby causing the sheets themselves to wind around said hollow casing.

As shown schematically in the figures from 3 to 6, suitable elements for guiding and feeding, such as rollers 12, or other equivalent elements, are arranged in correspondence with each winding member 1 in such a way as to guide the leading edge of the relevant sheet 11 towards the slot 4 in the hollow casing 3. The above-described device operates in the following way. By setting the heliographic machine in motion, after having mounted the two winding members 1, the relative shafts 7 will rotate continuously, for example, in an anti-clockwise direction as indicated by the arrows, with reference to the figures from 3 to 6. The tabs 10 will also move together with the shafts 7, passing through the apertures **9*a* in the plates 9, whereas the latter will remain stationary together with the hollow casings 3**.

Moreover, before the winding begins around the winding member 1, care must be taken that the slots 4 in the hollow casing 3 are facing towards the inside of the heliographic machine, i.e. towards the rollers 12 situated in correspondence with the delivery area of the sheets 11 to be rewound.

Figure 3:
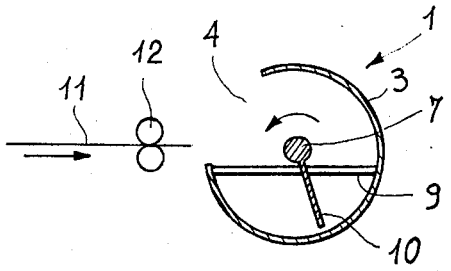
FIGS. 3, 4, 5 and 6 illustrate schematically, in cross section, a winding member of this invention, during an operating sequence at the initial stage of the rewinding of a sheet.

After having started up the heliographic machine in the usual way, inserting therein the original and the sensitive sheet, all the operator has to do is wait until the two delivered sheets are rewound automatically upon the two winding members 1. In the case of a single winding member, the sequence of operations takes place automatically in the following way: Whilst the relative sheet 11 is about to exit from the machine (FIG. 3), the hollow casing 3 remains stationary, with the slot 4 facing towards the rollers 12, whereas the shaft 7 continues to rotate together with the tabs 10; the latter, during rotation, pass through the corresponding apertures **9*a* provided in the plate 9**.

Figure 4:
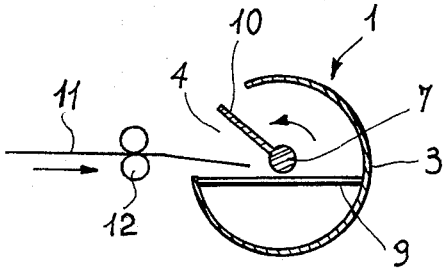
Figure 5:
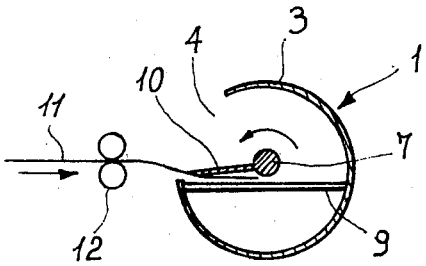

As the sheet 11 continues to move forward, the relative leading edge is automatically inserted into the slot 4, as shown in FIG. 4, whereas the hollow casing 3 still remains stationary. The tabs 10 then close over the leading edge (FIG. 5), pushing it towards the plate 9; in other words, the aforementioned leading edge is thus held firmly gripped between the tabs 10 and the plate 9. From this moment on, the tabs 10 are linked to the plate 9, and consequently the shaft 7 also pulls round the hollow casing 3 which, as mentioned previously, is mounted for free rotation about its axis.

Figure 6:
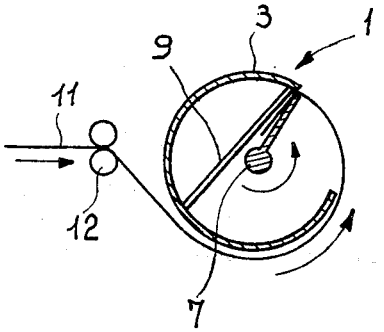

The sheet 11 thus begins to wind around the hollow casing 3 (FIG. 6), through the action of the shaft 7 which continues to rotate until the entire length of the sheet has been wound around the outer surface of the casing itself, in other words, until completion of the cycle of operations.

At this point the machine is turned off and the unloading of the roll takes place by temporarily removing the hollow casing 3 and the shaft 7 from the machine itself. Lastly, in order to slip the roll off the hollow casing 3, it is sufficient to rotate the shaft 7 by a few degrees on its axis, in the opposite direction to the previous direction of rotation, so that the tabs 10 release the leading edge of the sheet 11 previously held against the plate 9, making it possible to slip off the entire roll thus formed.

The same operation must also be carried out for the other winding member 1, in order to unload the roll wound around the latter. The heliographic machine is then returned to its original state, by replacing the hollow casings 3 together with the relative shafts 7 and by turning the slots 4 to face the rollers 12 (FIG. 3), so that the device is ready to carry out a new operating cycle.

As it can be clearly seen, the device of this invention makes it possible to achieve an accurate rewinding of the sheets delivered from the heliographic machine, without the need for any manual operations whatsoever, thus making the task of the operator considerably easier and permitting high working speeds. The invention, of course, is not restricted merely to the above-described embodiment, but numerous other final embodiments all falling within the context of the concept of this invention are possible.

Thus, for example, the securing of the leading edge of each sheet 11 to the respective hollow casing 3 can be carried out in a different way with respect to that heretofore described, by providing gripping devices operated by electromagnets or other equivalent methods, in place of the tabs 10.

What is claimed is:

1. Device for the automatic rewinding of material delivered in sheets in heliographic and similar machines, particularly for heliographic machines for textile industries, comprising:

at least one winding member mounted for free rotation about an axis, said winding member comprising a substantially cylindrical hollow casing presenting a substantially C-shaped cross section and defining a lengthwise slot extending along substantially the entire length of said hollow casing; and a motor-driven shaft mounted within said hollow casing coaxially with the axis of said winding member and provided with suitable means for securing the leading edge of a sheet to be rewound to said hollow casing after insertion of said sheet through said slot, said shaft, after securing of the leading edge, pulling round said hollow casing, in order to wind the sheet around the casing, said shaft extending substantially all along the entire length of said hollow casing, said means for securing the leading edge comprising a plurality of radial tabs fitted onto said shaft at intervals along the length of the aforesaid shaft, said shaft and tabs being rotatable within said hollow casing, corresonding elements being provided within said hollow casing for cooperating with said tabs to secure said leading edge between the tabs and said corresponding elements.

2. Device as claimed in claim 1, in which said corresponding elements comprise a strip-shaped plate fitted lengthwise within said hollow casing, along the entire length of the latter and provided with a plurality of crosswise apertures in correspondence with said tabs, so as to allow the latter to rotate freely, prior to the insertion of said leading edge of the sheet of material into the hollow casing.

3. Device as claimed in claim 2, in which one edge of said strip-shaped plate is fixed in coincidence with one edge of said slot of the hollow casing, whilst the other edge of the aforesaid plate 9 adheres to the inner surface of the hollow casing.

4. Device as claimed in claim 1, in which said radial tabs all face in the same direction and are in line with each other.

5. Device as claimed in claim 1, in which said hollow casing and said shaft are detachably mounted upon said heliographic machine, in order to permit the unloading of the rolls wound around said hollow casing.

6. Device as claimed in claim 1, in which said corresponding elements are formed as a strip-shaped plate integral with said casing and having a plurality of supporting sleeves, said shaft being rotatably inserted through the plurality of supporting sleeves secured at regular intervals to said strip-shaped plate.

7. Device as claimed in claim 1, in which, during the initial stage of the operating cycle, said slot in the hollow casing faces towards the inside of the heliographic machine in order to receive the leading edge of said sheet of material.

8. Device as claimed in claim 1, in which said shaft is connected through a clutch to a motor of the heliographic machine.

9. Device for the automatic rewinding of material delivered in sheets in heliographic and similar machines, particularly for heliographic machines for textile industries, comprising:

at least one winding member mounted in the machine for free rotation about its axis, said winding member comprising a substantially cylindrical hollow casing presenting a substantially C-shaped cross section and defining a lengthwise slot extending along the length of said hollow casing;

a strip-shaped plate having one edge secured to an interior surface of said casing and an opposite edge having a plurality of supporting devices; and a motor-driven shaft mounted coaxially within said hollow casing and extending through said supporting sleeves, said shaft being provided with means cooperating with said plate for securing the leading edge of a sheet to be rewound to said hollow casing after insertion of the leading edge into said slot, said shaft, after securing of the leading edge, pulling round said hollow casing in order to wind the sheet of material around the casing.

10. Device for the automatic winding of material delivered in sheet form by an apparatus, said device comprising:

a hollow casing mounted in the apparatus for free rotation about a casing axis;

a slit formed in and extending along the length of the casing so that a leading edge of a sheet to be wound is insertable into the interior of the casing;

a plate secured to an interior surface of the casing, the plate having a plurality of parallel apertures formed therein extending perpendicular to a plane containing the casing axis;

a shaft coaxially mounted within said casing, said shaft being rotatably driven by a motor of said apparatus and carrying a plurality of tabs arranged to pass through said apertures of said plate upon rotation of said shaft, the leading edge of the sheet being insertable into the casing through said slit and being secured by cooperation between said tabs and said plate, rotation of said shaft after securing of the leading edge rotating said casing so that the sheet is wound round the casing.

11. Device according to claim 10, wherein said plate carries a plurality of supporting sleeves for rotatably supporting said shaft.

* * * * *